United States Patent [19]

Rayner et al.

[11] 4,261,693

[45] Apr. 14, 1981

[54] PARTITION BLOCK AND METHOD OF MANUFACTURE

[75] Inventors: Basil M. Rayner; Robert Harrison, both of London, England

[73] Assignee: Beachcroft Concrete Partitions Limited, London, England

[21] Appl. No.: 13,000

[22] Filed: Feb. 21, 1979

[30] Foreign Application Priority Data

Feb. 21, 1978 [GB] United Kingdom ..... 6868/78
Jun. 16, 1978 [GB] United Kingdom ..... 27092/78

[51] Int. Cl.[3] ..... B28B 1/04
[52] U.S. Cl. ..... 425/431; 249/151
[58] Field of Search ..... 425/253, 431; 249/151

[56] References Cited

U.S. PATENT DOCUMENTS

| | | | |
|---|---|---|---|
| 1,594,310 | 7/1926 | Long | 425/431 X |
| 2,492,463 | 12/1949 | Carlsen | 425/431 X |
| 2,875,499 | 3/1959 | Ross | 425/253 X |
| 4,063,866 | 12/1977 | Lurbiecki | 425/431 X |

*Primary Examiner*—Thomas P. Pavelko
*Attorney, Agent, or Firm*—Edwin E. Greigg

[57] ABSTRACT

This invention relates to a partition block and method of manufacture. According to the invention a generally solid block or like component having a tool engaging recess is manufactured in apparatus comprising a mould box, recess forming means for forming a recess in a face of the block formed in the mould box and tamping means, the arrangement being such that tamping of a composition in the mould box is effected by the tamping means independently of the recess forming means.

14 Claims, 12 Drawing Figures

PARTITION BLOCK AND METHOD OF MANUFACTURE

BACKGROUND OF THE INVENTION

This invention relates to a method of manufacturing components, to apparatus for carrying out the method and to components manufactured in accordance with the method.

The traditional building block is the familiar brick which is small enough to be handled manually without difficulty. With the advent of larger blocks such, for example, as breeze blocks and party-wall blocks, the relative size of the block makes it difficult to handle the block single-handed and in consequence, an operator when laying a wall of these blocks needs to prepare his cement or mortar in the location to which the block is applied and then to use both hands to lift the block into position.

With ordinary breeze blocks or insulated building blocks and the like this is not a particular problem, but with party wall blocks, the weight and dimensions of the block are sufficient to make, in some instances, the lift a difficult one.

The problem is solved by providing each block with a recess in a face thereof, the recess being specifically arranged to receive engaging members of a hand operated tool so that when the tool is lifted, walls of the recess are engaged by the engaging members. In this manner, a block is lifted one handed by means of the tool.

Although blocks can be manufactured quickly by using an industrialized process, whereby the blocks are moulded in batches in a mould box from a semi-dry mix poured thereon, when it is necessary to provide such blocks each with a tool engaging recess therein, it is difficult to manufacture the blocks quickly because each time a mould box is prepared for moulding blocks, it is necessary to locate in the mould box formers which will form the tool engaging recess in each of the moulded blocks.

OBJECTS AND SUMMARY OF THE INVENTION

According to the present invention there is provided a method of moulding a generally solid block or like component having a tool engaging recess which method comprises the steps of:

pouring into a mould a curable composition comprising a cement and aggregate, closing the mould whereby the closed mould includes recess forming means, tamping the composition using tamping means separate from said recess forming means to form a block of said composition in said mould, removing the block from the mould, and thereafter causing or allowing the composition forming said block to cure.

After the composition has been poured into the mould and during tamping of the composition, the mould may have inserted therein the recess forming means.

The recess forming means may be inserted in the mould in the same direction as the tamping means when the tamping means is moved to tamp the composition.

The block may be removed after a predetermined period subsequent to pouring the composition.

The block may be cured in the presence of heat for a predetermined period.

The period in the presence of heat may comprise an initial period to allow for natural hydration of cement and during which the block is in the presence of air and a subsequent period during which the block is in the presence of hot wet steam.

The composition may comprise cement mixed with aggregate in the ratio of 1.5 to 1.20 by weight.

Also according to the present invention there is provided apparatus for moulding a generally solid block or like component having a tool engaging recess comprising:

a mould box, recess forming means for forming a recess in a face of a block formed in the mould box, and tamping means, the arrangement being such that tamping of a composition in the mould box is effected independently of the recess forming means.

The recess forming means is adapted to provide a blind recess in the said face of the block.

The recess forming means may be carried by the tamping means.

The recess forming means may be carried by a base plate.

The apparatus may be provided with an auxiliary base plate adapted to be resiliently mounted on said base plate for movement relative to said recess forming means, said auxiliary base plate being provided with an aperture for receiving said recess forming means.

The tamping means may comprise a tamping head carried by a first carrier plate and the recess forming means comprises a peg carried by a second carrier plate disposed in a plane substantially parallel to the first carrier plate, the carrier plates being movable relative one to another in a direction at right angles to said plane.

The apparatus may be provided with stop means to limit relative movement of the recess forming means and the tamping means.

The stop means may comprise a pin extending in spaced parallel relationship to the peg, the pin being secured to the first carrier plate and slidable within an aperture in the second carrier plate, an end portion of the pin remote from the first carrier plate being provided with means adapted to engage the second carrier plate.

The means adapted to engage the second carrier plate may comprise an outwardly extending circumferential flange.

The first carrier plate may be provided with an extended portion and the second carrier plate is provided with a guide for guiding the extended portion during relative movement of the first and second carrier plates.

The tamping means may comprise a cylinder one end of which is secured to the second carrier plate and a central longitudinal axis of a bore of the cylinder being co-axial with at least a portion of the central longitudinal axis of the peg.

The cylinder may be provided at an end thereof remote from the second carrier plate with an outwardly extending circumferential flange.

The said end of the cylinder may be provided with an end wall having an aperture therein adapted to receive the peg with a sliding fit.

The second plate may be provided with a plurality of said tamping means and the first carrier plate may be provided with a plurality of said pegs each corresponding to an associated one of said tamping means.

The apparatus may include conveyer means for supporting a plurality of said base plates to present said base plates sequentially under the mould former whereby the mould former is presented onto each said base plate to define the mould per se.

Apparatus may include means for releasing the block from the mould, by raising the tamping means and the mould former from the or each said base plate to leave a block on the or each said base plate.

The means for filling said mould may comprise a movable chamber, said chamber being open upwardly and adapted to receive a feed of the curable composition from a feed hopper, said chamber being adapted to deposit contents therefrom over the mould so that on movement of the feed hopper subsequent to discharge of the material, surplus composition is removed from the mould.

Also according to the present invention there is provided a component manufactured in accordance with the method as defined above.

BRIEF DESCRIPTION OF THE DRAWINGS

Following is a description, by way of example only and with reference to the accompanying drawings, of one method of carrying the invention into effect.

In the drawings:

Referring to FIGS. 1 to 7 of the drawings, a mould box 10 comprises an elongate rectangular frame 11 having parallel side walls 12, 13 and parallel end walls 14, 15. The frame 11 has a central longitudinal rib 16 extending parallel to the side walls 12, 13 and a plurality of spaced parallel transverse ribs 17 extending parallel to the end walls 14, 15 thereby defining a plurality of rectangular sub-frames 18. One of the sub-frames 18 is provided with a plurality of formers 19 extending inwardly from walls thereof. The mould box 10 is provided with an upper peripheral outwardly extending flange 20 which is supported by ribs 21 extending normal to the outer surfaces of the side walls 12, 13 and webs 22 contiguous with the end walls 14, 15. The end walls 14, 15 also are provided with upper outwardly extending flanges 23, 24 extending parallel to and below the flange 20, the flanges 23, 24 having portions **23*a*, 24*a* extending beyond the flange 20. Each of the extending portions 23a, 24*a* is provided with apertures 25 spaced in a direction transversely of the flanges 23, 24. The end walls 14, 15 are provided with ribs 26 extending outwardly at right angles thereto and below the flanges 23, 24**.

Figure 1:
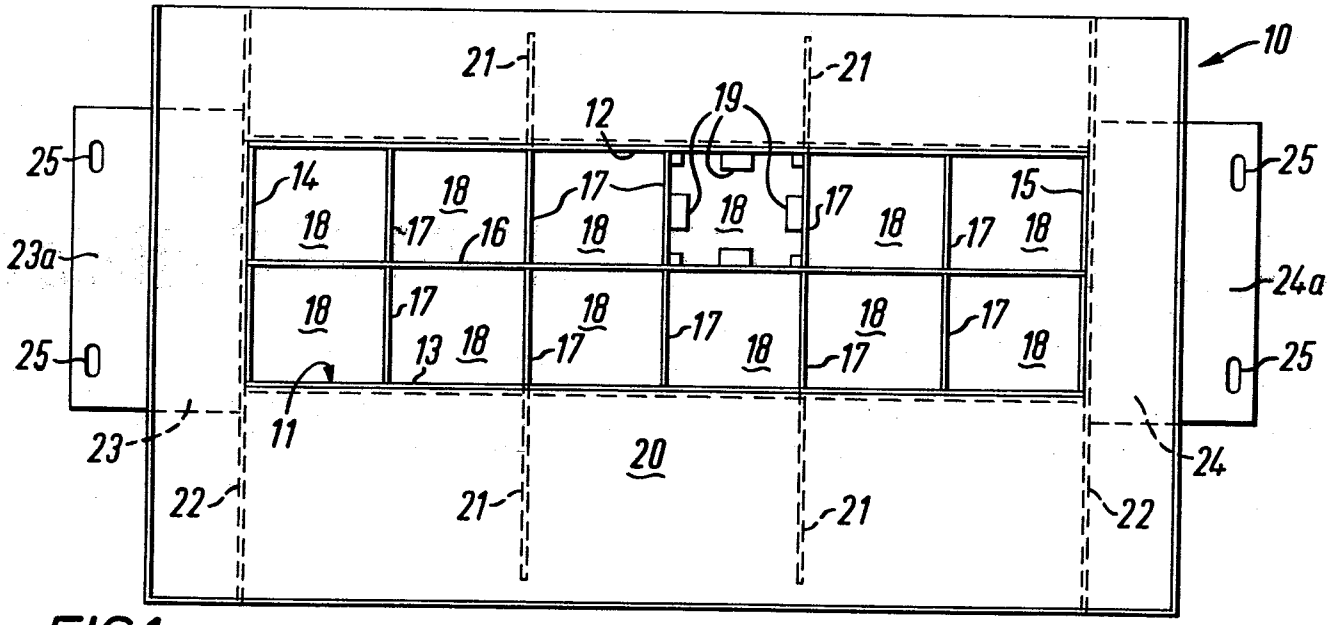
FIG. 1 is a plan view of one embodiment of a mould box in accordance with the present invention.
Figure 2:
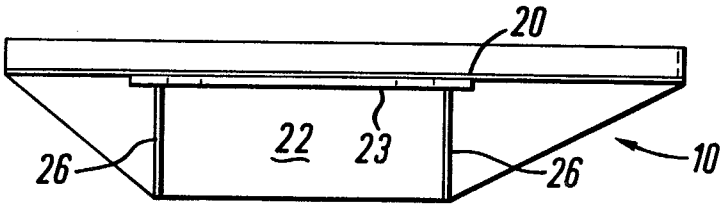
FIG. 2 is an end elevation of the mould box.
Figure 3:
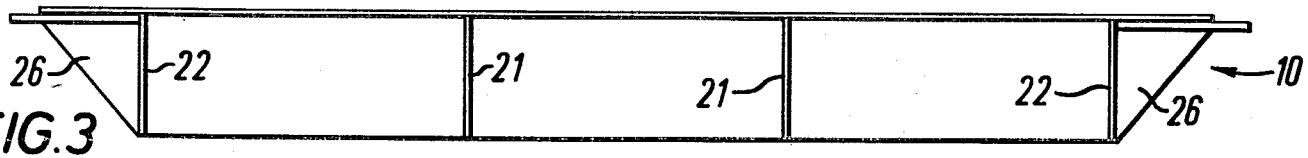
FIG. 3 is a side elevation of the mould box.
Figure 4:
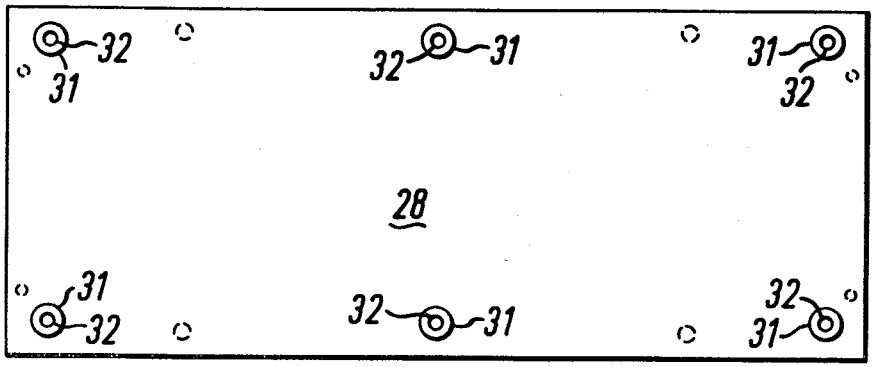
FIG. 4 is a plan view of a tamper head for use with the mould box.
Figure 8:
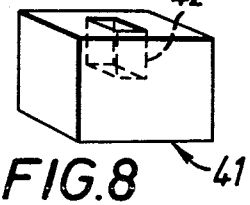
FIG. 8 is a perspective view of a component manufactured in accordance with the present invention.
Figure 5:
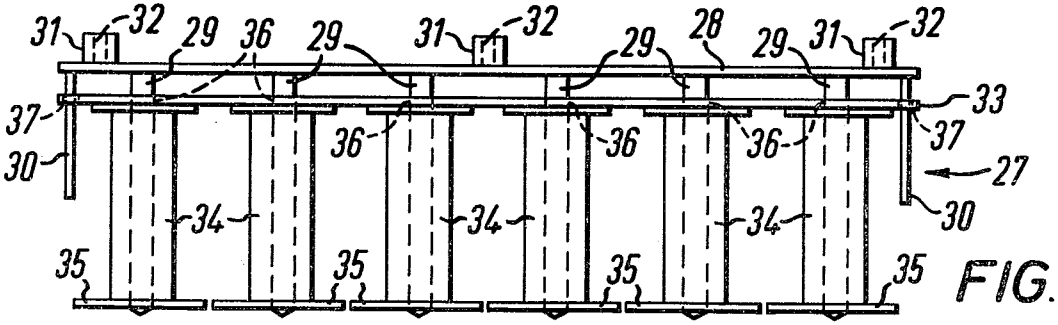
FIG. 5 is a side elevation of the tamper head shown in an inoperative position.
Figure 6:
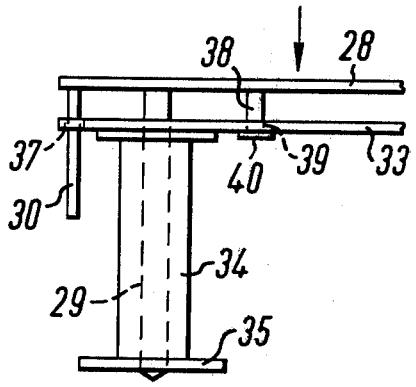
FIG. 6 is a diagrammatic representation of the tamper head shown in an inoperative position.

The mould box 10 has used in co-operation therewith a tamper head 27 comprising an elongate upper rectangular plate 28 having a plurality of spaced parallel pegs 29 depending therefrom and a plurality of pins 30 depending therefrom at opposite ends thereof. The upper plate 28 has at the corners thereof and at intermediate locations adjacent long sides thereof cylindrical members 31 upstanding from an upper surface of the upper plate 28. Each of the cylindrical members 31 has a recess 32 therein.

The tamper head 27 also comprises a lower rectangular plate 33 having secured to a lower surface thereof so as to depend therefrom a plurality of cylindrical members 34 the lower ends of which are provided with end walls (not shown) each having an aperture therein and a radially outwardly extending circumferential flange 35. The lower plate 33 has a plurality of apertures 36 each adapted to receive an associated peg 29 so that the pegs 29 are longitudinally slidable through apertures 36 and the central longitudinal bores of the cylindrical members 34. The lower plate 33 also is provided at opposite ends thereof with apertures 37 adapted to receive the pins 30 so as to be slidable therein. The upper plate 28 also is provided with depending studs 38 and the lower plate 33 is provided with apertures 39 each adapted to receive a respective one of the studs 38. The studs 38 each have at an end portion thereof remote from the upper plate 28 a radially outwardly extending flange 40 adapted to be engaged by a lower surface of the lower plate 33 when the upper plate 28 is raised a predetermined distance from the lower plate 33. The mould 10 and the tamper head 27 are used to provide a plurality of blocks 41 each having an aperture 42 therein from a semi-dry mix which may be a mixture of any one of the following:

7.0 $N/mm^2$ Strength in Lightweight Aggregate

120. Kgs. O.P. (Ordinary Portland) Cement to 36 cu.ft. Aggregate 10.5 $N/mm^2$ Strength in Lightweight Aggregate 134 Kgs. O.P. Cement to 36 cu.ft. Aggregate 10.5 $N/mm^2$ Strength in Dense Ballast Aggregate 120. Kgs. O.P. Cement to 20 cu.ft. Aggregate In use, the mould box 10 is located on a pallet so that each of the sub-frames 18 together with an upper surface of the pallet provide moulds and the tamper head 27 is located in a raised position above the moulds with the plate 33 raised relative to the plate 28 so that the pegs 29 project beyond the lower surfaces of the flanges 35 of the cylinders 34.

Figure 7:
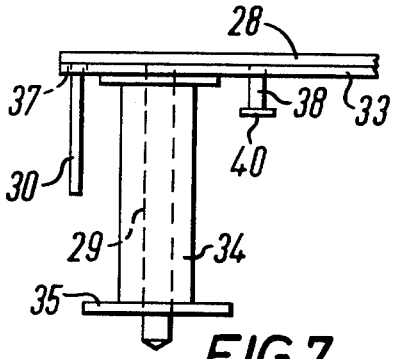
FIG. 7 is a diagrammatic representation of the tamper head shown in an operative position.

The composition then is poured into the moulds so that each of the moulds is filled and the tamper head 27 is lowered towards the mould box 10 so that the flanges 35 of the cylindrical members 34 engage the composition in each of the sub-frames 18 and the pegs 29 enter the composition to form recesses therein. At this stage the upper plate 28 is in engagement with the lower plate 33, as shown in FIG. 7, when continued downward pressure on the tamper head 27 causes the flange 35 of the cylindrical members 34 to bear on the composition in each of the sub-frames 18 and the head assembly is vibrated to produce tamping of the composition to compact the same to form unitary blocks 41. When the mixture has been in the mould box 10 for approximately 15 seconds, a tool (not shown) is arranged to engage the apertures 25 of the flanges 23, 24 of the mould box 10 and raises the mould box from the pallet so that the mould box and the tamper head 27 are raised together. In this manner the blocks 41 are pushed from the sub-frames 18 by the flanges 35 of the cylindrical members 34 as the mould box 10 and the tamper head 27 are raised leaving the blocks 41 on the pallet. The upper plate 28 of the tamper head 27 is then lifted relative to the mould box 10 and the pegs 29 move relative to the lower end walls of the cylindrical members 34 so that any mix remaining on the outer surfaces of the pegs 29 is wiped therefrom, the flanges 40 of the studs 38 engaging the lower plate 33 to prevent the pegs 29 from being withdrawn from the cylindrical members 34.

The pallet supporting the blocks 41 subsequently is placed in a steam oven where the blocks hydrate for approximately two hours and then hot wet steam at atmospheric pressure is introduced into the oven for at least a further two hours. The blocks 41 then are cooled slowly for the remaining portion of the 24 hour cycle.

Figure 9:
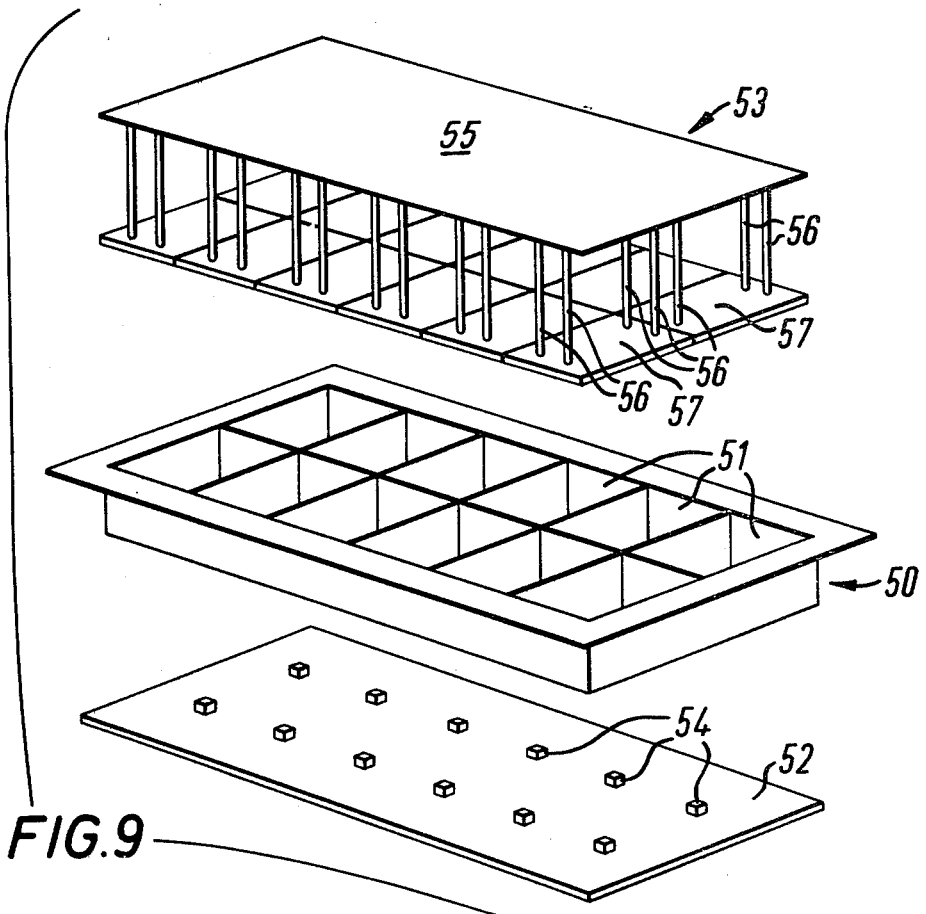
FIG. 9 is a perspective view of another embodiment of a mould box, a tamper head and a pallet in accordance with the present invention.

Referring now to FIG. 9, there is shown a rectangular mould box 50 having a plurality of rectangular sub-frames 51, a pallet 52 and a tamper head 53 adapted for use with the mould box 50. The pallet 52 is provided with a plurality of spaced pegs 54 upstanding from the pallet 52, each of the pegs being of rectangular transverse cross-section. The tamper head 53 comprises a rectangular plate 55 having a plurality of pairs of pins 56 depending therefrom, the lower ends of the pins having secured thereto rectangular tamper plates 57, each tamper plate having secured thereto two pairs of pins 56.

In use, the mould box 50 is supported on the pallet 52 so that the sub-frames 51 and an upper surface of the pallet 52 comprise a plurality of moulds each of the pegs 54 being contained within each of the moulds. A semi-dry mix is then poured into each of the moulds and the tamper head 53 is located so that the tamper plates 57 compact the mix to form unitary blocks in the moulds, each of the blocks having a recess therein formed by a corresponding peg 54. After the blocks have been formed, the tamper head 53 and the mould box 50 are together raised from the pallet 52 thereby causing the blocks to be pushed through the sub-frames 51 and retained on the pallet 52. The pallet 52 having the blocks thereon is placed in a steam oven so that the blocks are cured. After the blocks have been cured, they are inverted so that the recess in each block is in an upper surface thereof.

Figure 10:
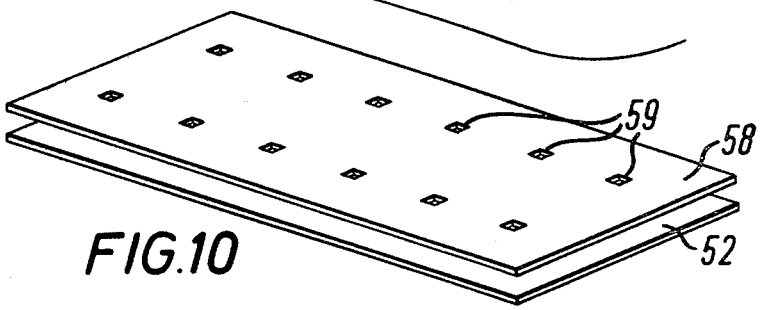
FIG. 10 is a perspective view of the pallet shown in FIG. 9 and of a base member for use therewith in accordance with the present invention.

Referring now to FIG. 10, there is shown the same pallet 52 as shown in FIG. 9, the pallet having had laid thereon a base member 58 having a plurality of spaced rectangular apertures 59 each being adapted to receive a peg 54 of the pallet 52. The pallet 52 has located thereon resilient means (not shown) for urging the base member 58 in an upward direction from the pallet 52 when the base member 58 is positioned relative to the pallet 52 so that the pegs 54 are located by the apertures 59 of the base member 58.

When the base member 58 is supported on the pallet 52 and the mould box 50 is located on the base member 58, the base member 58 is urged towards the pallet 52 against the resilient bias by the weight of the mould box 50 whereby the pegs 54 extend through corresponding apertures 59 of the base member 58. Semi-dry mix is then poured into the moulds and is compacted by the tamper head 53.

When the mould box 50 and the tamper head 53 are raised from the base member 58, the base member 58 is urged away from the pallet 52 by the resilient bias thereby moving the base member 58 upwardly relative to the pegs 54 so that the pegs are withdrawn from the blocks. The base member 58 with the blocks thereon then is removed from the pallet 52 and is replaced by another base member 58 and the process is repeated. Meanwhile, the base member 58 supporting the blocks is located in an oven and the blocks are cured therein.

Figure 11:
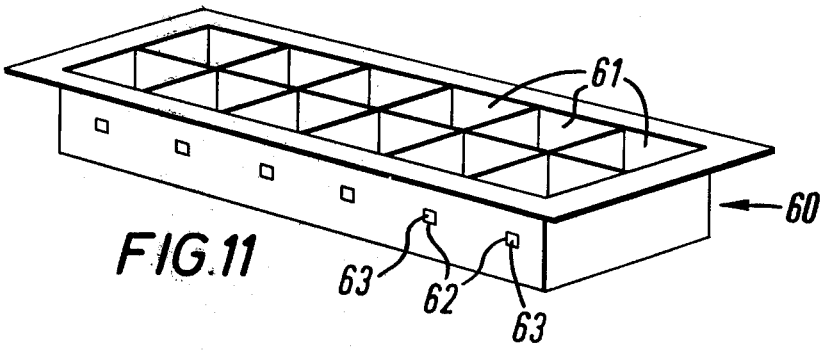
FIG. 11 is a perspective view of another embodiment of a mould box in accordance with the present invention.

Referring now to FIG. 11, there is shown a rectangular mould box 60 comprising a plurality of rectangular sub-frames 61. The mould box 60 has a pair of opposite facing walls each provided with a plurality of rectangular apertures 62 through which are inserted a plurality of core members 63 of rectangular transverse cross-section, each core member 63 extending transversely inwardly of a corresponding sub-frame 61.

The mould box 60 is located on a pallet (not shown) so that the sub-frames 61 and an upper surface of the pallet comprise a plurality of moulds. The moulds have poured therein a semi-dry mix. A tamper head (not shown) similar to the tamper head 53 in FIG. 9 is used to compact the mix in the moulds to form blocks each having a recess therein formed by a corresponding one of the core members 63. After the blocks have been formed, each of the core members 63 is removed from the mould box 60 through an associated aperture 62. The mould box 60 and tamper head then are raised from the pallet and the pallet having the blocks thereon is placed in an oven where the blocks are cured.

Figure 12:
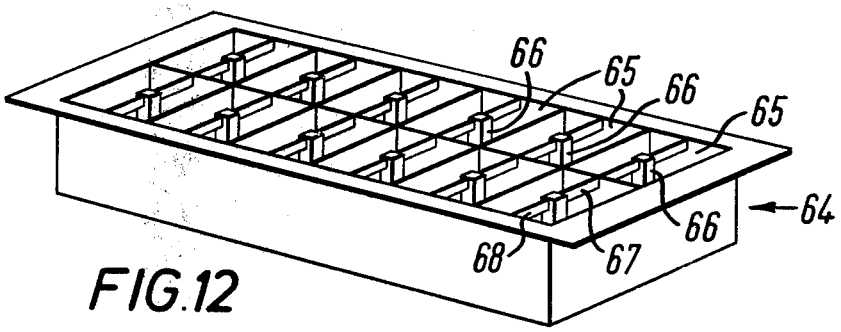
FIG. 12 is a perspective view of another embodiment of a mould box in accordance with the present invention.

Referring now to FIG. 12, there is shown a rectangular mould box 64 having a plurality of rectangular sub-frames 65 and a plurality of elongate core members 66 each of rectangular cross-section. Each of the core members 66 is located in an associated one of the moulds 65 by means of a pair of arms 67, 68 extending transversely of an associated core member and being secured to opposite facing walls of a corresponding sub-frame 65 whereby a central longitudinal axis of each core member extends parallel to the walls of a corresponding sub-frame 65. The mould box is located on a pallet (not shown) to comprise a plurality of moulds and a semi-dry mix is poured into each of the moulds and is compressed by a tamper head (not shown) having tamper plates adapted to be received in each of the moulds between the walls of each sub-frame 65, and the core member 66 and arms 67, 68 located therein. After a semi-dry mix has been poured into the moulds and compressed by the tamper plates to form blocks, each having a bore of rectangular cross-section with a core member 66 extending therethrough, the mould box 64 and associated tamper head are raised from the pallet thereby pushing the blocks through the sub-frames 65 and longitudinally of the core members 66 extending therethrough. The pallet having the blocks located thereon then is placed in an oven where the blocks are cured.

We claim:

1. Apparatus for moulding a generally solid block or like component having a tool engaging recess comprising:

a mould box for receiving material and for moulding said material to form said block;

means for forming a recess in said material in said mould during formation of said block, said recess forming means being movable relative to said mould box;

means relative to said mould box for tamping said material in said mould during formation of said block said tamping means being movable relative to said mould box and said recess forming means; and means for moving said tamping means relative to said mould box to tamp said material in said mould box, whereby movement of said tamping means in successive strokes to tamp said material in said mould box is coordinated with said recess forming means so that said recess forming means enters said material in successive strokes in sequence with said strokes of said tamping means.

2. Apparatus as claimed in claim 1, wherein said recess forming means is carried by said tamping means.

3. Apparatus as claimed in claim 1 wherein said mould box is provided with a base and said recess forming means is carried by said base.

4. Apparatus as claimed in claim 3, wherein said mould box is provided with a base having an aperture therein and said recess forming means is adapted to enter said mould box through said aperture, said recess forming means being resiliently biased against movement into said mould box through said aperture.

5. Apparatus as claimed in claim 1 wherein the tamping means comprises a tamping head carried by a first carrier plate and the recess forming means comprises a peg carried by a second carrier plate disposed in a plane substantially parallel to the first carrier plate, the carrier plates being movable relative one to another in a direction at right angles to said plane.

6. Apparatus as claimed in claim 5 wherein the first carrier plate is provided with an extended portion and the second carrier plate is provided with a guide for guiding the extended portion during relative movement of the first and second carrier plates.

7. Apparatus as claimed in claim 5 wherein including stop means for limiting relative movement of the recess forming means and the tamping means.

8. Apparatus as claimed in claim 7 wherein the stop means comprises a pin extending in spaced parrallel relationship to the peg, the pin being secured to the first carrier plate and slidable within an aperture in the second carrier plate, an end portion of the pin remote from the first carrier plate being provided with means adapted to engage the second carrier plate.

9. Apparatus as claimed in claim 8 wherein the means adapted to engage the second carrier plate comprises an outwardly extending circumferential flange.

10. Apparatus as claimed in claim 5 wherein the tamping means comprises a cylinder one end of which is secured to the second carrier plate and a central longitudinal axis of a bore of the cylinder being co-axial with at least a portion of the central longitudinal axis of the peg.

11. Apparatus as claimed in claim 10 wherein the cylinder is provided at an end thereof remote from the second carrier plate with an outwardly extending circumferential flange.

12. Apparatus as claimed in claim 11 including means for releasing the block from the mould, by raising the tamping means and the mould from the or each said base plate to leave a block on the or each said base plate.

13. Apparatus as claimed in claim 11 wherein the said end of the cylinder is provided with an end wall having an aperture therein adapted to receive the peg with a sliding fit.

14. Apparatus as claimed in claim 13 wherein the second carrier plate is provided with a plurality of said tamping means and the first carrier plate is provided with a plurality of said pegs each corresponding to an associated one of said tamping means.

* * * * *